United States Patent [19]

Biebuyck

[11] Patent Number: 5,058,344

[45] Date of Patent: Oct. 22, 1991

[54] WALL PANEL SYSTEM

[75] Inventor: Lawrence Biebuyck, Garland, Tex.

[73] Assignee: Butler Manufacturing Corporation, Kansas City, Mo.

[21] Appl. No.: 492,980

[22] Filed: Mar. 13, 1990

[51] Int. Cl.[5] ..... E06B 7/14

[52] U.S. Cl. ..... 52/235; 52/208; 52/397

[58] Field of Search ..... 52/208, 209, 235, 397, 52/398

[56] References Cited

U.S. PATENT DOCUMENTS

| | | | |
|---|---|---|---|
| 2,407,085 | 9/1946 | Ledwinka et al. | 52/208 |
| 3,367,077 | 2/1968 | Johnston | 52/464 |
| 3,380,210 | 4/1968 | Neal et al. | 52/235 |
| 3,734,550 | 5/1973 | Vance | 52/235 |
| 3,881,287 | 5/1975 | Biebuyck | 52/127 |
| 3,881,294 | 5/1975 | Biebuyck | 52/720 |
| 3,916,595 | 11/1975 | Biebuyck | 52/747 |
| 3,961,452 | 6/1976 | Hubbard et al. | 52/475 |
| 4,004,389 | 1/1977 | DiFazio | 52/398 |
| 4,006,573 | 2/1977 | Biebuyck | 52/732 |
| 4,008,552 | 2/1977 | Biebuyck | 52/397 |
| 4,010,671 | 3/1977 | Hubbard et al. . | |
| 4,030,260 | 6/1977 | Sukolics et al. | 52/397 |
| 4,050,201 | 9/1977 | Hubbard et al. | 52/209 X |
| 4,055,923 | 11/1977 | Biebuyck | 52/235 |
| 4,194,776 | 3/1980 | Biebuyck | 292/346 |
| 4,310,995 | 1/1982 | Hanna | 52/806 |
| 4,364,209 | 12/1982 | Gebhard | 52/208 |
| 4,387,542 | 6/1983 | Wehr | 52/209 |
| 4,545,161 | 10/1985 | Baumann | 52/235 |
| 4,611,447 | 9/1986 | Krechel | 52/209 |
| 4,614,069 | 9/1986 | Tanikawa | 52/235 |
| 4,627,201 | 12/1986 | Hamamoto | 52/208 |
| 4,644,717 | 2/1987 | Biebuyck | 52/209 |
| 4,662,136 | 5/1987 | Tanikawa | 52/235 |
| 4,662,145 | 5/1987 | Tanikawa et al. | 52/235 X |
| 4,680,902 | 7/1987 | Stefnik | 52/242 |
| 4,685,263 | 8/1987 | Ting | 52/235 |
| 4,773,193 | 9/1988 | Biebuyck | 52/93 |
| 4,866,896 | 9/1989 | Shreiner et al. | 52/235 |

*Primary Examiner*—Rodney M. Lindsey
*Assistant Examiner*—Suzanne L. Dino
*Attorney, Agent, or Firm*—Johnson & Gibbs

[57] ABSTRACT

An improved panel mounting system for curtain wall construction of the type comprising a plurality of transparent and non-transparent panels secured to structural millions and disposed adjacent each other wherein the panels are constructed with an outer hollow region integrally formed with structural interconnection means.

13 Claims, 3 Drawing Sheets

WALL PANEL SYSTEM

BACKGROUND OF THE INVENTION

1. Field of the Invention

The present invention relates to building systems and, more particularly, to a curtain wall panel system utilizing an integrated panel mounting assembly.

2. History of the Prior Art

The prior art is replete with curtain wall designs and assembly techniques adapted for particular applications. In the main, these systems include various extruded aluminum shapes and profiles which form horizontal mullions that are secured to vertical, structural mullions. The mullion systems provide not only a structural lattice but also means for mounting panels thereon. The types of panels which may be used with such a curtain wall system vary. Transparent panels made of single or multiple pane glass are common. Likewise, solid panels of various materials such as stone, steel, aluminum and the like, have found widespread acceptance. Such panels may be used either separately or in combination with other types of panels. However, various assembly features must be taken into consideration when modifying the various panel sizes, shapes, thicknesses, as well as the type of panel material being utilized.

A large number of prior patents illustrate the state of the curtain wall construction as it pertains to both mounting techniques for panels and drainage aspects of the mullion. This is partly because there are a large number of considerations in the construction and installation of a curtain wall. These considerations include the manner in which the generally hollow aluminum mullion drains and the manner in which such mullions are used for the mounting of panels thereto. For example, glazing pockets are generally provided as a part of the mullion. The glazing pockets facilitate the mounting of the panels in direct engagement with the horizontal extruded members. Glazing strips are then received therein to prevent water infiltration. It is obviously important to maximize the effectiveness of the sealing configuration in order to prevent water intrusion. Several prior patents illustrating such extruded aluminum mullion and the glazing gasket configurations thereof include U.S. Pat. Nos. 4,773,193; 4,644,717; 4,194,776 and 4,055,923. These and other patents comprise technology dealing with curtain wall systems of which the current applicant is the inventor. The use of glazing strips and various sealing configurations are therein addressed.

In many instances the glazing pocket itself forms one of the most critical aspects of the mullion profile. Various panel sizes and mounting techniques necessitate variations in glazing pocket size and shape. Such modifications necessitate an emphasis on material characteristics. The usefulness of aluminum is most widely recognized relative to fabrication and its ability to be extruded into complex shapes. The cost of an extrusion die is much less than the cost of roll forming equipment typically used to shape steel. For this reason, aluminum has generally been utilized over roll formed steel for complex mullion configurations for curtain wall systems. There are certain designs, however, which incorporate the advantages of roll formed steel in a configuration that facilitates a structural interengagement allowing the use of steel over aluminum. One such design is set forth as shown in co-pending patent application Ser. No. 07/430,795 assigned to the assignee of the present invention. In that application, the advantages of both aluminum and roll formed steel are amply described, set forth and shown. Likewise, a number of prior art references are described and many of those references pertain to curtain walls and panel assembly mounting techniques. That patent application (Ser. No. 07/430,795) is incorporated herein by reference.

In the aforesaid co-pending patent application Ser. No. 07/430,795, the mounting of transparent glass and solid stone panels is addressed. The mounting of the stone panels necessitates various structural and functional design considerations. The mounting of lighter weight conventional panels is a more prevalent consideration. Conventional panels for curtain wall assemblies generally include a pair of stainless steel sheets, or the like, between which is disposed a honeycombed filler. Generally, the honeycomb is made from lightweight aluminum and a suitable adhesive is utilized to create a bonded sandwich configuration. The mounting of these panels to the curtain wall then becomes another design consideration. The panels in each case must comprise an element of the curtain wall which is sealably mounted therein. Such a sealed mounting generally requires the utilization of glazing pockets for the adjacent receipt of panels such as glass. A number of prior art designs address this particular problem, and the following patents manifest a variety of design approaches in the mounting of such panels in a curtain wall system.

U.S. Pat. No. 4,680,902 issued to Stefnick is a 1987 patent teaching a unitized partition system. This reference teaches a partition wall system utilizing a series of rectangular panel assemblies, each having outer and inner walls and a stiffening medium such as a honeycomb filler disposed there between. The honeycomb is recessed from the side walls. A spline is provided for being received within the recessed channel to facilitate assembly. This is not an integral construction and the spline is not taught to be integrally formed with the honeycomb panel. The splines may also include lateral extensions, which extensions may mate with the channels of adjacent panel assemblies to join the assemblies together.

U.S. Pat. No. 4,611,447 issued to Kretchel is a 1986 patent teaching a curtain wall and windowframe construction. The panels of this windowframe construction system comprise inner and outer sheets between which is sandwiched a thermal insulating core adhesively bonded thereto. The outer sheet extends beyond the perimeter of the core to therein define a region adapted for receiving a structural member providing the means for securing the panel to the curtain wall mullion system. A structural flange is thus provided in a configuration adapted for being received within the region defined by the outer wall and the perimeter of the core whereby the flange may be secured to both the core and the structural mullion by suitable fastening means. The structural flange is of the type adapted to be installed during the curtain wall construction process into the region left vacant behind the outer sheet.

U.S. Pat. No. 4,387,542 issued to Wehr is a 1983 patent teaching an integrated window and wall system. In this patent a wall panel constructed with inner and outer sheets and a stiffening core therebetween is provided in a configuration adapted for mainly engaging an extruded aluminum member defining a glazing pocket therewithin. Appropriate sealing means and baffle members are provided with a drain and mullion system that permits sealing and structural interconnection with the panels and the glass.

U.S. Pat. No. 4,685,263 issued to Ting is a 1987 patent teaching an aluminum plate curtain wall structure. A plate connection system is taught therein whereby panels are secured to the plates which are themselves secured to the support mullion. The plates are designed to move relatively free in relation to the perimeter members for purposes of thermal expansion or contraction. This reference also shows an extrusion joint having a spline and back flanges that receive a vertical perimeter extrusion.

U.S. Pat. No. 3,367,077 issued to Johnson is a 1968 patent for an enclosure structure for buildings. This reference teaches the utilization of an extruded aluminum member adapted for engaging glass panes in parallel spaced relationship. The inner and outer elements of the assembly are clamped toward one another to apply pressure to the sealing means against the glass.

U.S. Pat. No. 4,310,995 issued to Hanna is a 1982 patent for panel assemblies and components of the type utilized in building construction. The use of a honeycombed filler sandwiched between two spaced wall structures is taught. The peripheral region is constructed with a channel therein. Serrations are to be used for the channel edge members for interengagement therebetween.

U.S. Pat. No. 4,614,069 issued to Tanikowa is a 1986 patent for a prefabricated curtain wall assembly. Various aluminum extrusion configurations and mounting assemblies are set forth and shown therein. Likewise, panel assemblies which are secured to the structural mullion are generally referred to.

U.S. Pat. No. 3,734,550 issued to Vance is a 1973 patent teaching a building construction assembly. This reference teaches various extruded aluminum configurations adapted for engaging the panel members such as glass and sealed engagement therewith. Consistent therewith, a generally channel-shaped condensate gutter is taught with locking interconnection system.

U.S. Pat. No. 4,662,136 issued to Tonakawa is a 1987 patent teaching a prefabricated curtain wall assembly. Horizontal rows of prefabricated mullion units are mounted to the respective floor systems of the building. Again, a number of aluminum extrusion configurations and panel mounting systems are set forth and shown along with sealing means for use therewith.

The above described prior art of curtain wall systems manifests one design direction of the prior art in attempting to utilize the most economical and useful construction approach for panel assemblies. The particular application in the present invention includes a panel having an integrated structural interconnection region therein. This region is provided for securing the panel to the mullion and facilitating the presence of the glazing pocket therearound. Such an approach overcomes the problems of the prior art in panel mounting assemblies not incorporating an integral construction. In addition, the present invention provides a building system incorporating a method of facilitating direct panel mounting.

SUMMARY OF THE INVENTION

The present invention relates to a method of and apparatus for mounting metal and visionary panels in curtain wall systems. More particularly, one aspect of the present invention includes a metal panel constructed with an outer peripheral region integrally formed with structural interconnection means and a glazing pocket for the visionary panel. The interconnection means allows the direct securement of the metal panel to the supporting mullions comprising the curtain wall and the mounting of the visionary panel adjacent thereto. The metal panels may be constructed with inner and outer plates sandwiching a structural filler therebetween. The structural filler may be constructed in a honeycomb configuration which honeycomb may be sandwiched and bonded to the inner and outer plates by suitable adhesive.

In another aspect, the invention includes an improved panel mounting system for curtain wall construction of the type wherein a plurality of metal panels are secured to structural mullions and disposed adjacent a plurality of visionary panels. The improvement comprises the metal panels having outer peripheral regions integrally formed with structural interconnection means for receipt of the visionary panels and securement to the mullions comprising the curtain wall. The interconnection means includes structural web sections integrally formed with the metal panel for facilitating the direct mounting of the panel to the structural mullions and the definition of the glazing pocket for mounting the visionary panel. The metal panels are constructed with outer and inner plates sandwiching a structural filler therebetween, and the outer and inner plates are secured to said filler by adhesive. The filler may comprise honeycomb, the adhesive being disposed about the outer surfaces of the honeycomb for direct bonding of the outer and inner plates thereto.

In another aspect, the invention includes a metal panel for a building system of the type adapted for securement to a structural mullion assembly for providing an outer surface thereon. The panel comprises first and second panel sheets, the first sheet comprising an outward surface of the panel and the second sheet providing an inside surface of the panel, the inside surface facing the mullion system. A panel filler is adapted for sandwiched positioning between the first and second panel sheets and the securement thereto. The first panel sheet extends peripherally beyond the second panel sheet and defines a hollow region therebetween and adjacent outer edges of the filler. Structural interconnection means are disposed within the hollow region of the panel and integrally formed therein for providing means for securement to the mullion assembly. Means are provided for interconnecting the structural means to the mullion assembly and defining a glazing pocket for receipt of a glass, or visionary, panel therein. The structural member comprises an extruded aluminum structural element adapted for direct securement to the first and second sheets and includes at least first and second webbed regions disposed in generally parallel spaced relationship and adapted for a flush abutting engagement with inside surfaces of the first and second sheets for direct securement thereto.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
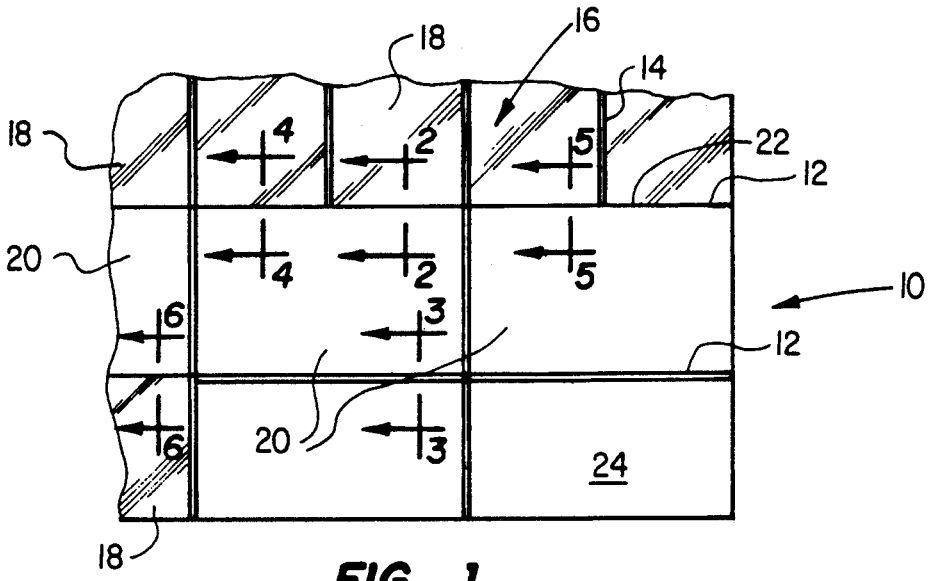
FIG. 1 is a front elevational, diagrammatic view of a building curtain wall system constructed in accordance with the principles of the present invention.

Referring first to FIG. 1, there is shown a representative curtain wall structure comprising the building system 10 of the present invention. Horizontal mullions 12 are linked to a series of vertical mullions 14 providing means for securing a variety of panels 16 therebetween. In certain instances, the horizontal mullion 12 is removed to illustrate various mounting techniques for panels 16. The panels 16 collectively include transparent glass, or visionary panels 18 and non-transparent metal panels 20. The panels 16 are secured between the horizontal mullions 12 and the vertical mullions 14. Multiple section lines are taken through mullions 12 and 14 to show incorporation of various embodiments of the present invention. Glass sections 18 are shown disposed above horizontal mullion 22 with the metal panel section 20 disposed therebeneath. Both the size and the configuration of the metal panel as well as the mounting mullion will vary for purposes of illustration. For example, the glass panel 18 abuts the intermediate metal panel 20 in a flush mounting configuration. There is no exposed mullion or cap extending horizontally thereacross. The metal panels 24 disposed beneath intermediate metal panels 20 are also shown to abut one with the other along a thin line of interconnection, indicating a flush mounting.

Figure 2:
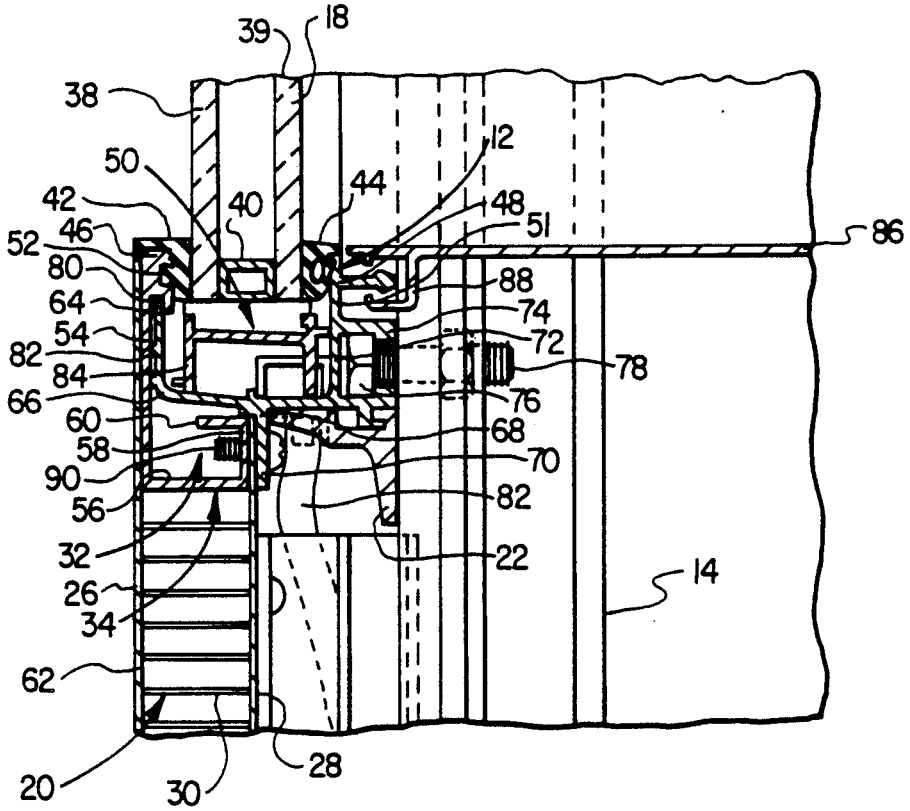
FIG. 2 is an enlarged, side elevational, cross sectional view of a portion of the curtain wall of FIG. 1 taken along lines 2—2 thereof.

Referring now to FIG. 2, there is shown an enlarged, side elevational cross sectional view of the panel 20 of FIG. 1 taken along lines 2—2 thereof. Glass panel 18 is disposed above metal panel region 20 and outside support mullion 14. Panel 20 is seen to be constructed of an outer metal sheet 26 and an inner metal sheet 28, between which is disposed a filler medium 30. The filler 30 may be honeycombed metal, or the like, which is bonded to the metal sheets by suitable adhesive. The panel 26 is constructed with a hollow region 32 disposed around the filler 30. The hollow region 32 shown in FIG. 2 is defined as that region between the peripheral areas of panel sheets 26 and 28, above filler 30. It is within this hollow, peripheral region 32 that the structural interconnection system 34 of the present invention is mounted for facilitating the direct securement of the panel 20 to mullion 14.

Still referring to FIG. 2, the glass panel 18 in the present illustration comprises a double glass pane assembly. An outer panel of glass 38 is disposed adjacent an inner pane of glass 39 with a spacer 40 disposed therebetween. A glazing rod 42 is disposed outwardly of pane 38, with an internal glazing rod 44 disposed inwardly of internal pane 39. Glazing rods 42 and 44 may be seen to be secured adjacent the glass panes by extruded members defining the glazing pocket therebetween.

Referring still to FIG. 2, an extruded aluminum member 48 defines the inside section of the glazing pocket in which panel 18 is secured. Glazing pocket sections 46 and 48 comprise different extruded structural members which are joined together to define the glazing pocket 50 in which the glass panel 18 is received in sealed engagement therewith. As discussed in more detail below, it is the interconnection between members 46 and 48 which provides one of the distinct advantages of the present invention.

Extruded member 48 as defined in this assembly, comprises a part of the elongate horizontal mullion 12. It is this horizontal mullion 12 that mounts directly to the vertical mullion 14 and upon which the various panels are permitted to rest. It is likewise in interconnection with this horizontal mullion 12 that the metal panels 20 are permitted to mount in structural engagement therewith for providing a structural mounting that is both aesthetically pleasing and functionally sound. The configuration of the horizontal mullion 12 is thus defined by the inner-relationship and the complemental configuration of the extruded member 46 which comprises a portion of the structural interconnection member 52 disposed within the peripheral hollow section 32 of the panel 30. Member 46 thus comprises the upper region of mounting member 52 which further includes a lower web section 54 and bottom web region 56. The bottom region 56 is joined in an orthogonal relationship with a relatively short back region 58, the end of which is likewise formed in generally parallel spaced relationship to bottom 56 and terminates in section 60. The member 52 is secured between the inner and outer sheets 28 and 26, respectively, by suitable adhesive 62. The same adhesive is utilized for bonding the honeycomb filler 30 therebetween. With this particular configuration, the panel 20 may be secured directly to the horizontal mullion 12. In the shown embodiment of the present invention, mullion 12 comprises extrusion 51. The extrusion 51 matingly engages the structure member 52, wherein a flange region 64 upstands from a lower web region 66 comprising a yoke area 68 from which depends a center web 70. The inside region of the web 70 includes a lateral flange region 72 from which is formed a structural interconnection section 74 adapted for receiving the head of a fastener member 76. The body 78 of fastener member 76 is shown extended through the vertical mullion 14.

Referring still to FIG. 2, the structural member 52 is formed with a lip 80 adapted for receiving and matingly engaging the web region 64 of the yoke section 70 of the mullion 51. A series of feet 82 may be formed along the outside surface of the web 64 for purposes of abutting engagement with the inside surface of the lower web 54 of the structural member 52. In this configuration both the panel 30 and the glass panel 18 are sealably mounted one to the other in direct interengagement therebetween. The configuration of the glazing pocket 50 thus facilitates a direct structural mounting facilitating both assembly and aesthetics. The glazing pocket 50 may include additional features such as drain tube 82A shown depending therefrom and setting block 84 disposed therein. Likewise stool trim 86 may be secured directly to the mullion by the incorporation of clip section 88 of conventional design. The only additional structural mounting of the panel 30 to the mullion 14 requires the utilization of a threaded fastener 90 shown extending through the central yoke section 68 and the back 58 of structural member 52. It is through the threaded fastener 90 that it may be seen that direct mounting of the panel 20 to the mullion 12 is provided.

Figure 3:
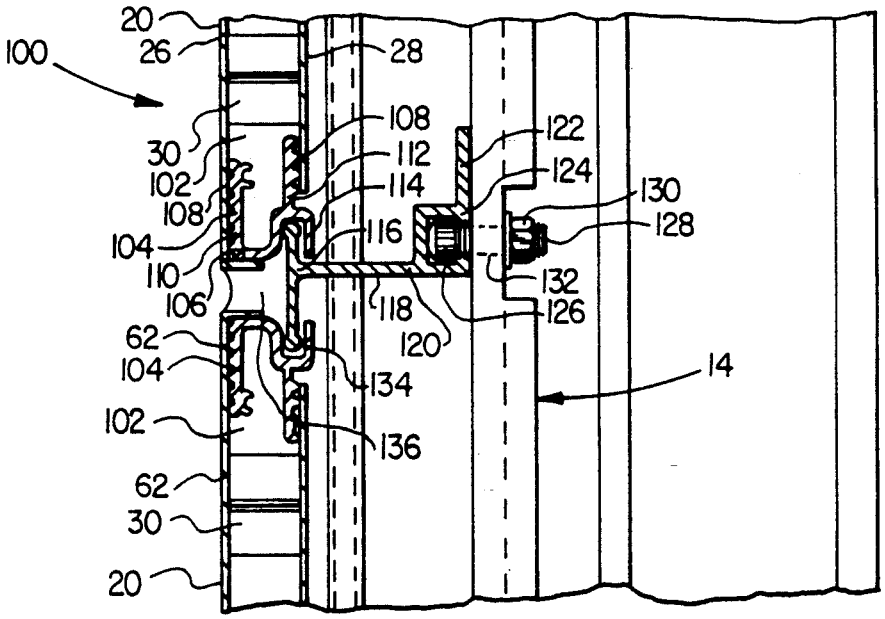
FIG. 3 is an enlarged, side elevational, cross sectional view of a section of curtain wall of FIG. 1 taken along lines 3—3 thereof.

Referring now to FIG. 3, there is shown an enlarged, side elevational cross sectional view of the panel mounting system of the present invention taken along lines 3—3 of FIG 1. In this particular view upper and lower panels 20 are disposed adjacent one another. In this configuration, a panel mounting system 100 is utilized. The panel mounting system 100 incorporates the basic principle of providing the panel 20 having a hollow peripheral region 102 formed below filler 30 in this particular view. It should be noted that the peripheral hollow region 102 may extend completely around the panel 20, or only on select sides such as above and below the filler 30. In this particular configuration the structural interconnection system 104 disposed within the hollow region 102 comprises a generally U-shaped body section 106 having a plurality of feet 108 formed outwardly therealong. Feet 108 extend outwardly of the parallel walls 110 and 112 of the U-shaped body member. The feet 108 engage the inside surfaces of the outer and inner panels 20 and 28, respectively, and are bonded thereto by appropriate bonding adhesive 62 as discussed above. The U-shaped body member further includes a mounting jaw 114 adapted for receiving mounting flange 116. The mounting flange 116 extends outwardly of a horizontal mounting mullion 118 and is secured directly to the vertical mullion 14.

Still referring to FIG. 3, the mounting mullion 118 includes an intermediate flange region 120 extending outwardly from a base region 122. Base region 122 is constructed with a mounting recess 124 within which is received mounting member, or bolt 126. The threaded end 128 of bolt 126 is constructed to receive a nut 130. An aperture 132 is provided for the passage of the bolt 128 therethrough. The outer flange region 116 of the horizontal support mullion 118 includes engagement head 134 adapted for being received within and matingly engaging the section 114 in direct mounting of the panel 20. Both the transverse and lateral movement of the panel 20 is thus restrained by this direct mounting which is facilitated by the simplified direct interconnection system. Any suitable sealant 136 may be injected between adjacent panels 20 for preventing water intrusion. The above comprises an alternative embodiment of the direct structural panel mounting system of the present invention wherein the structural mounting means is provided within a hollow mounting region of each panel disposed between the outer and inner panel sheets.

Figure 4:
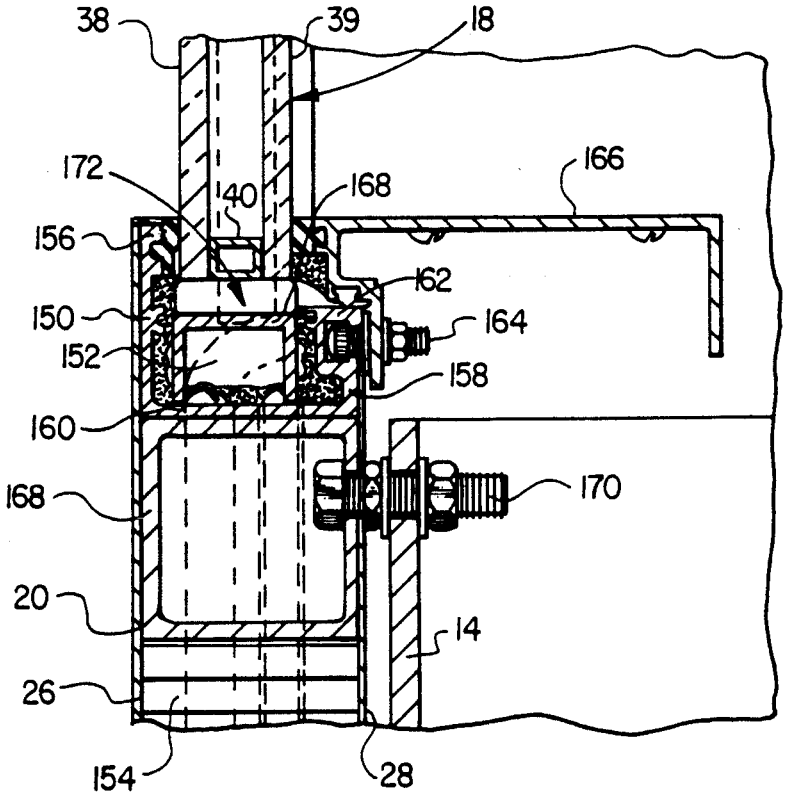
FIG. 4 is an enlarged, side elevational, cross sectional view of the curtain wall system of FIG. 1 taken along lines 4—4 thereof.

Referring now to FIG. 4, there is shown a large, side elevational, cross sectional view of the panel mounting in FIG. 1 taken along lines 4—4 thereof. In this particular view an alternative embodiment of the panel mounting structure is shown. The alternative embodiment, as compared to FIG. 2, is taken across the curtain wall section or glass panel 18 as disposed above a metal panel 20. A structural mounting member 150 is mounted in the peripheral region 152 above the structural filler 154 of the panel. The structural member 150 is comprised of a first outer web at region 156 disposed in parallel spaced relationship with an internal web member 158. A bottom section 160 connects the two members. A mounting recess 162 is formed on the inside flange 158 whereby a threaded fastener 164 may be utilized to mount various structural, functional, or decorative members, such as item 166 thereto.

The panel 20 may also be constructed with a structural insert or frame 168 bonded directly between sheets 26 and 28. The aluminum frame 168 is received within the honeycomb panel 154 and provides a means for mounting the panel directly to the vertical mullion 14. A threaded fastener 170 is thus shown extending outwardly from the frame 168 and inside sheet 28 of the panel 20 for this purpose. In this particular mounting configuration, the panel 20 provides improved mounting characteristics by providing not only a direct structural mounting system in the peripheral region thereof, which defines in itself a glazing cavity 172, but also an intermediate structural means in the form of aluminum mounting frame 168 which lies bonded or otherwise secured within the filler means to thereby provide direct means of structural support and interconnection to the mullion 14.

Figure 5:
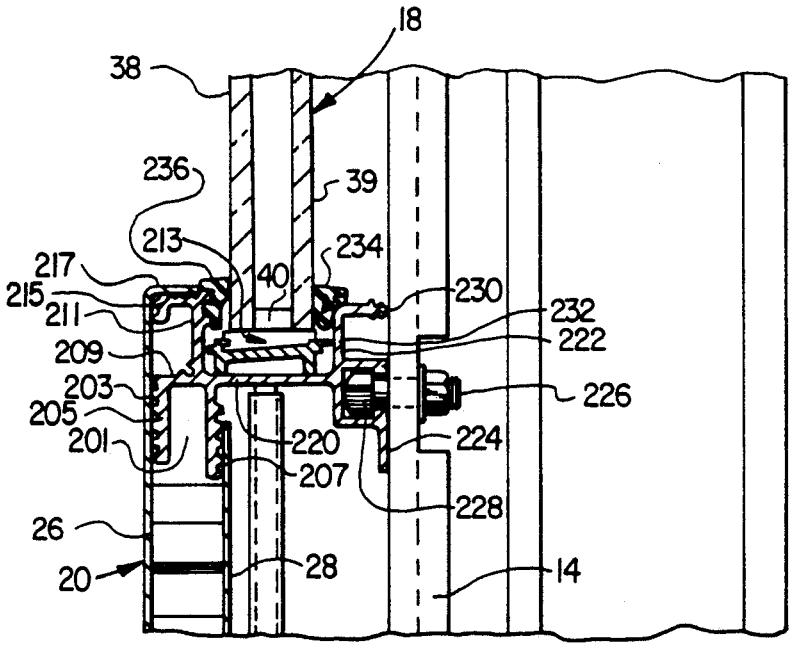
FIG. 5 is an enlarged, side elevational cross sectional view of an alternative embodiment of the curtain wall system of FIG. 4.

Referring now to FIG. 5, there is shown an alternative embodiment of a wall panel system incorporating the principles of the present invention. In this particular view, a glass panel is disposed above a metal panel such as that shown in FIG. 2. The mullion attachment is similar to that shown in FIG. 3. These variations are presented for purposes of illustration. The figure comprises the glass assembly 18 disposed atop the panel assembly 20. Outer and inner glass panes 38 and 39 are separated by spacer 40. Likewise the lower panel 20 is comprised of outer and inner sheets 26 and 28, respectively, between which is disposed honeycomb filler, or the like, as described above. As also described above, a peripheral hollow region 201 is provided for receiving an interconnection system 203 integrally constructed therewith. Interconnection system 203 comprises, in this particular embodiment, outer web region 205 and inner web 207 joined together by an upper web section 209. Upstanding from web section 209 is an intermediate web 211 which comprises one side of a glazing pocket 213. It is within glazing pocket 213 that the glass pane 18 is seated. Extending laterally atop web 211 is a top member 215. It may be seen that top web member 215 is mounted against a top sheet section 217 extending orthogonally to outer sheet 26 and forming the distal end of panel 20. It is within this distal end of panel 20 and within the hollow region 201 that the interconnecting system 203 is securely retained.

Still referring to FIG. 5, it may be seen that the interconnecting system 203 further includes an integral section adapted for direct interengagement with the structural mullion 14. An arm 220 is shown disposed inwardly from web region 209 for positioning a mounting section 222 adjacent the mullion 14. Mounting section 222 further includes a fastener section 224 within which is mounted a threaded fastener or bolt 226. A head recess 228 is provided for receipt of the bolt head therein for securing a flange region 229 thereagainst. An upper, orthogonally disposed flange region 230 is likewise formed for securing the thermal break or stool trim (not shown) therefrom. Upper section 230 further includes a web section 232 that itself forms the inside area of glazing pocket 213. The base of glazing pocket 213 is further defined by the arm 220 described above. Within the glazing pocket 213, glazing rods 234 and 236 may be directly mounted. The direct mounting of the glazing rods against the glass panes 38 and 39 is a marked advantage over many prior art assemblies. This is particularly true in the region of the upper glass where it is secured in sealed engagement as shown in FIG. 6, for example.

Figure 6:
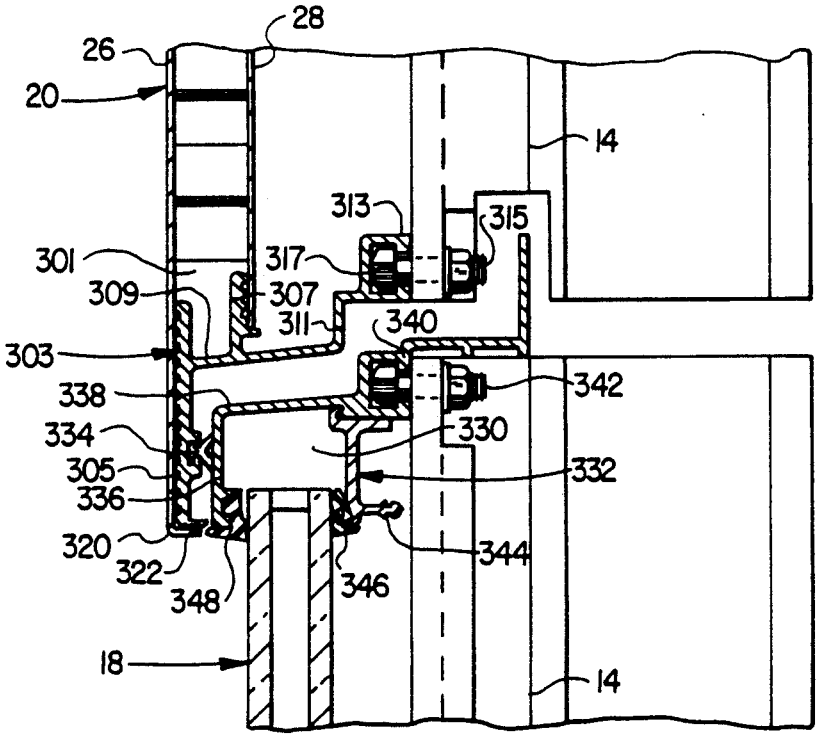
FIG. 6 is an enlarged, side elevational, cross sectional view of the curtain wall system of FIG. 1 taken along lines 6—6 thereof.

Referring now to FIG. 6, it is specifically an advantage to have a removable glazing adapter rather than permanent sealants positioned between the glass and the glazing pocket walls in case there is some movement of the glass relative to said glazing pocket walls. Permanent sealers such as Silicone sealant and the like, although flexible, may often times not provide sufficient flexibility to allow the full range of thermal and dynamic expansion necessary for fully loaded building curtain wall configurations. This problem is particularly manifested in the upper panel regions.

Still referring to FIG. 6, yet another alterative embodiment of the curtain wall panel assembly system of the present invention is shown. In this particular embodiment the glass panel section 18 is disposed beneath the metal panel section 20. Again metal panel 20 is comprised of an outer sheet 26 disposed adjacent an inner sheet 28 between which a filler 30 is disposed. A hollow, peripheral region 301 is disposed outwardly of the filler and between the outer and inner sheets 26 and 28, respectively. Within the hollow region 301 an interconnecting member 303 is disposed. Interconnecting member 303 of this particular embodiment comprises an aluminum extrusion which is adapted for direct mating engagement with structural mullion 14 and integral securement within the panel 20. Member 303 thus includes an outer mounting web 305 disposed in generally parallel spaced relationship with an inner-mounting web 307. Webs 305 and 307 are joined together by connecting web 309. Connecting web 309 further extends inwardly beyond web 307 into a generally Z-shaped section 311. Z-shaped section 311 is constructed with a mounting section 313. Mounting section 313 is adapted for receipt of a threaded fastener 315, wherein a recess 317 is formed. Head recess 317 is adapted for butting engagement against the mullion 14. In this particular configuration the outer sheet 26 of the panel 20 further includes a nose region 320 which extends around the web 305 and an elbow section 322 thereof. Elbow section 322 finds itself in flush engagement with nose section 320 and it is preferable that all sections 305, 322 and 307 are directly bonded to the panel sheets 26 and 28 during the fabrication of the panel 20. In this configuration a secure structural interconnection system is provided and, in the present embodiment, one is provided that affords relative movement between the panel 26 and the glass panel 18 during periods of thermal expansion and/or dynamic movement.

Still referring to FIG. 6, it may be seen that the glass panel 18 is received within a glazing pocket 330 not defined directly by the structural interconnection member 303. Instead, in this particular embodiment, glazing pocket 330 is directly defined by a structural mounting member 332 which is mounted adjacent to structural mounting member 303. A wiper gasket 334 is disposed between the two members 303 and 332 and contiguous thereto for purposes allowing movement therebetween. With the sealing member 334 movement can be afforded while still maintaining the sealed engagement between the two sections.

The glazing pocket 330 may be seen to be defined by outer glazing pocket section 336 extending downwardly from upper arm 338. Upper arm 338 terminates in a mounting section 340 in which is secured a threaded fastener 342. Threaded fastener 342 is secured directly to the mounting mullion 14. A lower web section 344 depends therefrom for defining the glazing pocket 330 and providing means for the securement of the glass panel 18 therein. Suitable glazing rods 346 and 348 are disposed between the glass panel 18 and the side walls of glazing pocket 330 as described above. In this particular configuration a mounting is afforded that permits an integral construction of the panel 20 and maximum flexibility in the building system.

Having described the invention in connection with certain specific embodiments thereof, it is to be understood that further modifications may now suggest themselves to those skilled in the art and it is intended to cover such modifications as fall within the scope of the appended claims.

What is claimed is:

1. An improved panel mounting system for curtain wall construction of the type wherein a plurality of transparent and non-transparent panels are secured to structural mullions and disposed adjacent one another, the improvement comprising said non-transparent panels being constructed with outer and inner plates sandwiching a structural filler therebetween and being formed with an outer hollow region along at least one side thereof defined by said outer and inner plates and said outer hollow region being integrally formed during manufacturer of said panels with structural interconnection means for securing said transparent and non-transparent panels one to the other and to said mullions comprising said curtain wall, said interconnection means including structural web sections integrally formed within said outer hollow region for facilitating the direct structural mounting of said non-transparent panel to said structural mullions and the receipt of said transparent panel therein.

2. The apparatus as set forth in claim 1 wherein said outer and inner plates are disposed in generally parallel spaced relationship and secured to said filler by adhesive.

3. The apparatus as set forth in claim 2 wherein said filler comprises honeycomb, said adhesive being disposed about the outer surfaces of said honeycomb for direct bonding of said outer and inner plates thereto.

4. The apparatus as set forth in claim 2 wherein said interconnection means is sandwiched between said inner and outer plates and permanently secured within said hollow region to further define a glazing pocket for receipt of said transparent panel.

5. The apparatus as set forth in claim 4 wherein said web section of said interconnection means includes first and second body members disposed in generally parallel spaced relationship and adapted for abuttingly engaging said inner and outer plates in said sandwiched position, said first and second members being joined by a transverse structural arm defining a lower portion of said glazing pocket and facilitating the structural mounting of said panel to said mullion.

6. The apparatus as set forth in claim 5 wherein said first and second members of said web sections are constructed with serrated outer surfaces thereof for facilitating direct structural engagement with said inner and outer plates.

7. The apparatus as set forth in claim 5 wherein said members of said web sections form a generally U-shaped member integrally formed with and structurally assembled for the mounting of said non-transparent panel to said structural mullion and the receipt of said transparent panel therein.

8. A metal panel for a building system of the type adapted for securement to a structural mullion assembly for providing an outer surface thereon and the securement of a visionary panel adjacent thereto, said metal panel comprising:

first and second metal sheets, said first sheet comprising an outward surface of said metal panel and said second sheet providing an inside surface of said metal panel, said inside surface facing said mullion system;

a filler sandwiched between said first and second sheets and secured thereto, said filler being peripherally recessed relative to said sheets to define a hollow region therebetween;

structural means disposed within said hollow region for securing said metal panel to said mullion assembly; and means for integrally securing said structural means within said hollow region during manufacture of said panel, said means including a first structural web integrally formed within said hollow region between said first and second sheets.

9. The apparatus as set forth in claim 8 wherein said filler comprises a honeycomb section bonded to said sheets.

10. The apparatus as set forth in claim 8 wherein said web of said structural means comprises an element of an extruded aluminum structural member adapted for direct securement to said first and second sheets, said structural member being formed to define at least one wall of a glazing pocket adapted for receipt of said visionary panel therein.

11. The apparatus as set forth in claim 10 wherein said web of said structural member includes first and second body members disposed in generally parallel spaced relationship and adapted for being sandwiched between said inner and outer sheets, said first and second body members being joined by a transverse structural arm facilitating the structural mounting of said metal panel to said mullion.

12. The apparatus as set forth in claim 11 wherein said first and second body members are constructed with serrated outer surfaces thereof for facilitating direct engagement with said inner and outer sheets.

13. The apparatus as set forth in claim 12 wherein said first and second body members of said web form a generally U-shaped member which is integrally formed with and structurally assembled in said hollow regions for the mounting of said panel to said structural mullion.

* * * * *

UNITED STATES PATENT AND TRADEMARK OFFICE

CERTIFICATE OF CORRECTION

PATENT NO. : 5,058,344

DATED : October 22, 1991

INVENTOR(S) : Lawrence Biebuyck

It is certified that error appears in the above-identified patent and that said Letters Patent is hereby corrected as shown below:

Abstract, line 4 delete -- "millions" -- insert -- "mullions" --

Column 10, line 25, delete "mvnfacturer" insert --manufacture--.

Signed and Sealed this

Thirtieth Day of March, 1993

*Attest:*

STEPHEN G. KUNIN

*Attesting Officer*

*Acting Commissioner of Patents and Trademarks*